United States Patent [19]

Farina

[11] Patent Number: 4,584,968

[45] Date of Patent: Apr. 29, 1986

[54] CYLINDRICAL BOILER

[75] Inventor: Alfred J. Farina, Baldwin, N.Y.

[73] Assignee: Thormocatalytic Corporation, Williston Park, N.Y.

[21] Appl. No.: 757,484

[22] Filed: Jul. 22, 1985

[51] Int. Cl.[4] ..... F22B 5/00

[52] U.S. Cl. ..... 122/14; 122/161; 122/183

[58] Field of Search ..... 122/160, 161, 183, 14

[56] References Cited

U.S. PATENT DOCUMENTS

| | | | |
|---|---|---|---|
| 544,019 | 8/1895 | Wilson et al. | 122/183 |
| 1,616,143 | 2/1927 | Schnepp | 122/183 X |
| 1,980,425 | 11/1934 | Morgan | 122/183 |
| 4,329,943 | 5/1982 | Schworer | 122/161 X |

*Primary Examiner*—Edward G. Favors
*Attorney, Agent, or Firm*—Bauer & Amer

[57] ABSTRACT

A heat exchanger is formed of a pair of concentrically arranged open-ended cylindrical shells, defining a chamber therebetween, in through which water can pass. Each end of the pair of shells is closed by a removable cap. A combustion element extends into the inner shell from one end along the axis thereof and is connected to a source of heat such as a gas/air mixture which ignites in the combustion element causing the radiation of heat outwardly from the combustion element. A continuous helical wire is located in the chamber, between the inlet and the outlet and in contact with the opposing walls of the chamber to convert the chamber into an elongated helical passage.

2 Claims, 4 Drawing Figures

CYLINDRICAL BOILER

BACKGROUND OF THE INVENTION

The present invention relates to an radiant heated-water boiler and in particular to an improved cylindrical construction therefor.

In prior, U.S. Pat. No. 4,442,799, of which the present applicant is a co-inventor, a radiant heated-water boiler is disclosed having a heat exchanger comprising a cylindrical shell, in which a gas fired combustion element is concentrically disposed. The combustion element is connected to a heat source, such as a gas/air mixture, which is ignited within the combustion element, the ignited gases passing through the element into the surrounding hollow shell. Disposed at a clearance position, about the combustion element is a helically coiled tube, through which water is pumped, which water thus absorbs the heat radiated from the combustion element.

In the present applicant's co-pending application of Ser. No. 730,388, an improved boiler construction is disclosed wherein the inner shell is formed as a corrugated wall, thereby defining a spiral path for the water and similar contra-directed path for the radiant heat source.

While these constructions are highly effective and more efficient than those heat exchange arrangements previously known, several disadvantages have not been fully overcome. For example, the use of a helically coiled tube or corrugated inner shell continues to result in high costs, complex structure, and labor intensiveness for assembly and repair.

It is an object of the present invention to provide a cylindrical boiler for use in a radiant heated-water boiler which is simpler in construction than those known heretofor and which provides improved efficiency in operation.

It is a particular object of the present invention to provide a cylindrical boiler for use in radiant heated-water boilers which can be formed from readily available and/or easily manufactured parts, and which can be easily assembled and disassembled.

These objects as well as other objects, features and advantages will be more fully appreciated from the following disclosure of a presently preferred but nevertheless illustrative embodiment.

SUMMARY OF THE INVENTION

According to the present invention, a radiant heated-water exhanger is provided having a boiler formed of a pair of concentrically arranged open-ended extruded cylindrical shells, the opposing interior walls being smooth and defining therebetween a chamber for holding a fluid. An inlet to the chamber extends through the outer shell at one end and an outlet therefrom at the other end. Located between the shells and in abutment with the wall of each shell is a continuous helically disposed wire. The wire extends from one end to the other and defines, in the fluid chamber, a helical passage from the inlet to the outlet. The ends of the chamber formed between the shells are each closed by a removable cap which is provided with annular recesses receiving the ends of the shells, so as to also maintain their coaxial disposition fixed. The caps are held to the shells by a removable clamping fixture.

A combustion element extends into the inner shell through the cap at one end and is connected to a source of fuel such as a gas/air mixture which ignites in the combustion element causing the radiation of heat outwardly from the combustion element. Preferably the heat exchanger is provided with a gas cooling or exhaust element in the form of a plug arranged along the central axis in opposition to the combustion element. The surfaces of the concentric shells, not in opposition to each other, may be provided with ribs, flutes, or the like to enhance heat exchange, and to hold the plug in place.

Full details of the present invention are set forth in the following description and illustrated in the accompanying drawing.

DESCRIPTION OF THE INVENTION

Figure 1:
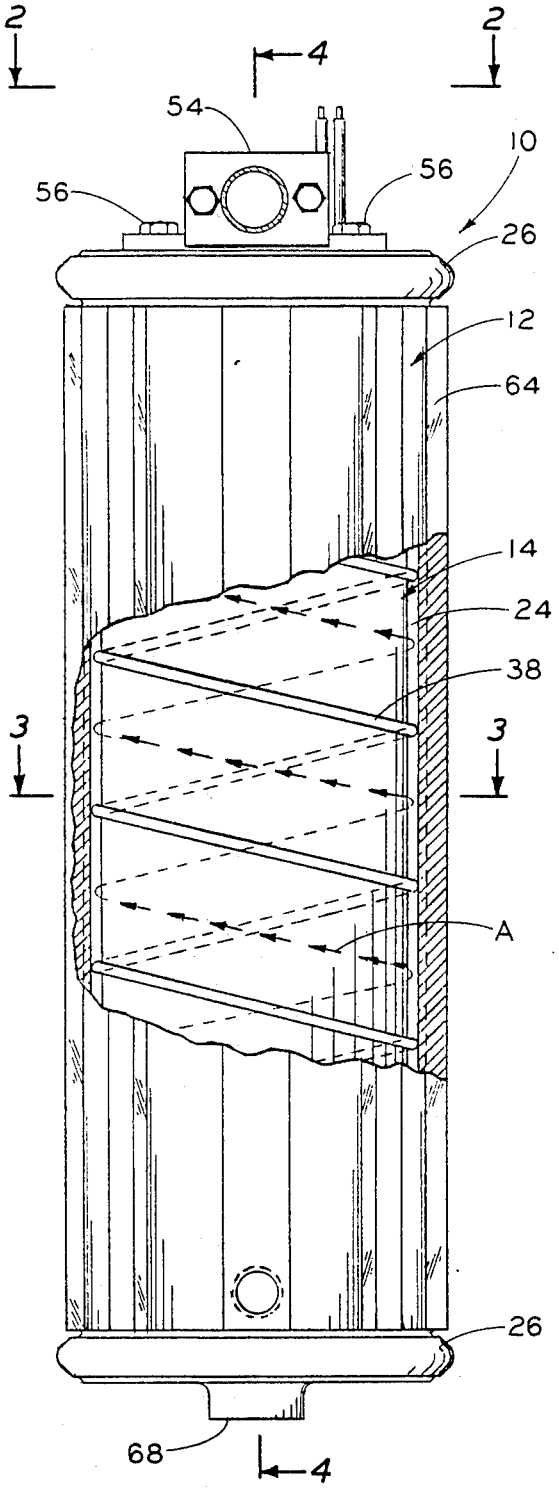
FIG. 1 is a partial section through the length of the boiler embodying the present invention.
Figure 2:
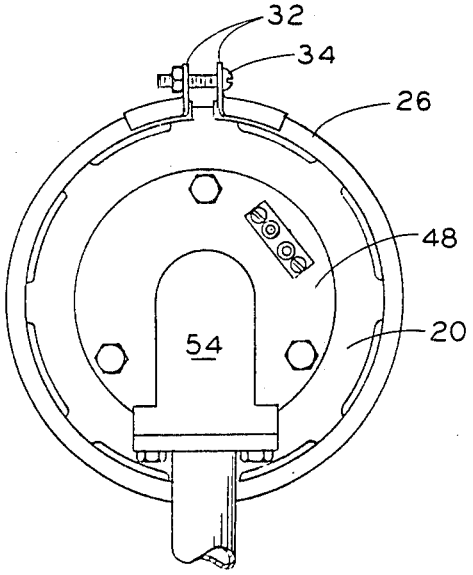
FIG. 2 is a plan view of the boiler in the direction of line 2—2 of FIG. 1.
Figure 4:
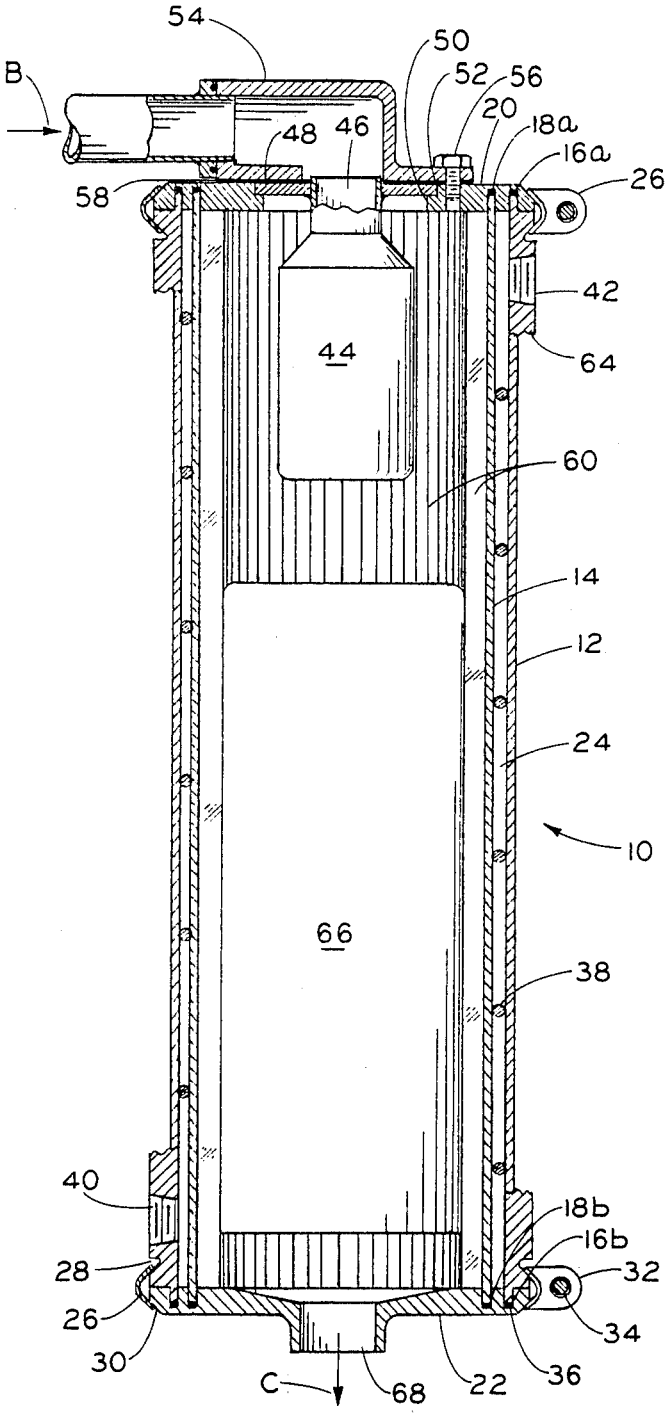
FIG. 4 is a longitudinal sectional view of the boiler taken along line 4—4 of FIG. 1.

As seen in FIGS. 1 and 2, the heat exchanger comprises a boiler generally depicted by numeral 10, formed of an outer cylindrical shell 12 and an inner cylindrical shell 14, concentrically spaced from each other. In FIG. 4, the ends of both shells are open and are secured in annular slots 16 (*a,b*) and 18 (*a,b*) respectively formed in an annular upper cap 20 and lower cap 22 which hold the inner shell 14 in a fixed position relative to the outer shell 12, so as to define therebetween a closed annular chamber 24 along its entire length, in which water to be heated may be located.

The upper and lower caps 20 and 22 are secured in fluid tight relationship to the shells by a band clamp 26, having a V-shaped cross-section fitting into a peripheral groove 28 along the edge of the outer shell and a beveled edge 30 on the cap. The band clamp 26 is tightened by drawing the ends 32 of the clamp together, by a threaded bolt 34. The upper and lower clamps are identical and therefore interchangeable. The bolt is easily loosened making removal of the cap simple, when the boiler is to be dismantled for repair. Pressure seals required between the cap and the shells are simple O-ring seals 36 seated in the grooves 16 (*a,b*) and 18 (*a,b*).

Firmly held between the interior facing walls of shell 12 and 14 is an elongated continuous helically wound wire 38. The wire 38 is of such rigidity that it maintains a fixed disposition and is of such diameter that it abuts simultaneously the surface of both shells. As a result, it forms with the wall of the interior chamber 24 a helical passage from one end of the boiler to the other for the flow of fluid, as indicated by the arrow A in FIG. 1.

An inlet 40 is provided for introduction of cooling water, through the outer shell 12 adjacent its lower end and an outlet 42, for heated-water passes through the shell adjacent its upper end.

A porous combustion element 44 having an inlet neck 46 is appropriately mounted in a central clearance position within the inner shell 14. The neck 46 of the combustion element is swaged into a flange-like plate 48 which sits on a shoulder 50 surrounding a central hole 52 in the upper cap 20. Mounted on top of the cap 20 so as to firmly seat the flange plate 48 is a conduit fitting 54 which communicates with a source of combustible gas, (not shown) which is forced under pressure, in the direction of arrow B into the combustion element 44 and through the porosity of its wall construction so that it radiates radially therefrom. As shown, the conduit fitting 54 is fastened to the cap 20 by at least screw bolts 56, and an appropriate seal 58 is interposed about the neck 46 so as to seal against gas/air or combustion product leakage. In this manner, the cap 20, the combustion element 44, the inlet duct and conduit fitting 54 are formed as a single assembly so that they can be removed jointly. On the other hand, the removal of the bolt 56 alone permits removal of the conduit fitting 54 so that the seal 58, and combustion element 44 can be easily lifted out through the hole 52, without disturbing the arrangement of the boiler shells 12 and 14 and/or the cap 20.

The form of the surfaces of the shells 12 and 14 lying outside and inside relative to the chamber 24 are not critical and they may be flat, but it has been found that enhanced heat conductivity is obtained when the innermost surface of the inner shell 14 is formed so as to have a plurality of longitudinally and parallel oriented flutes 60 providing improved heat transference surfaces. the flutes 60 should be black coated or anodized which greatly increases the radiant heat absorptivity especially in the area adjacent to the radiant burner 44 and top of plug 66. The outermost surface of the outer shell is provided with enlarged embossments 64, also extending longitudinally. The embossment 64 provides added strength and provides the means for attaching band clamps 26 and inlet and outlet water connections 40 and 42. This construction eliminates all welding. Preferential construction of this boiler is aluminum or other types of extrusions for shells 12 and 14. Caps 20 and 22 may be castings.

Figure 3:
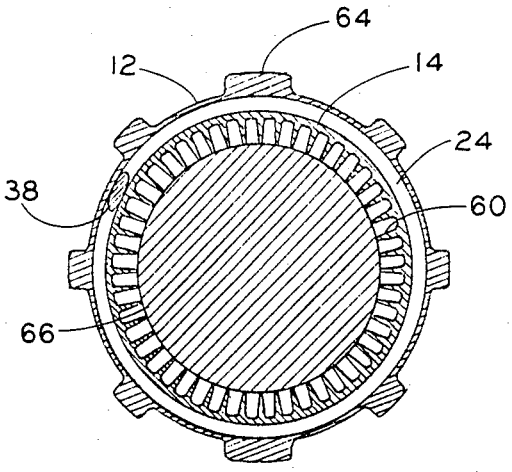
FIG. 3 is a transverse sectional view of the boiler taken along line 3—3 of FIG. 1.

A plug 66, made of a ceramic or metallic material is located within the inner shell. It is preferred that the plug be in a force fit, tightly against the edges of flutes 60, within the inner shell, extending upwardly from the lower or remote end opposite the combustion elements. The plug prevents the rapid escape of the incendiary core of exhaust gases from the inner shell 14. The lower cap 22 is provided with an exhaust outlet 68. The plug 66 regulates the escape of exhaust gas, while at the same time enables very efficient heat transfer between the hot gases and longitudinal fluted individual heat transfer channels 100 (FIG. 3) formed by flutes 60 and plug 66. This effect reduces the size of the boiler. When a ceramic plug is used, the incendiary gas causes the plug itself becomes hot and glow, adding to the heat within the inner shell. The gas is cooled as it passes around the plug and exits through an outlet 68 in the lower end passing through the lower cap 22 (Arrow C). Boiler water and incendiary gas flow are counterflow.

Although the structure described is different from that described in my earlier mentioned patent and copending application, the basic operation of the heat exchanger is similar so that further details of the combustion elements, plug, and water flow will be apparant to those skilled in this art, making reference to those disclosures. The configuration of the outer shell 12 and inner fluted shell 14 also provides an added advantage of reducing the pressure requirement for water flow and the blower which provides the gas/air mixture to burner 44 which reduces operating costs and manufacturing costs when compared to the earlier mentioned patent.

As understood, and as described in my aforementioned earlier Patent and copending application, the operation of the combustion element 44 contemplates igniting the combustion gases with the result that at, or near, the periphery of the surface of element 44 there is the referred-to combustion reaction that is manifested by incandescence of the porous body. As a result, the radially flowing exhaust gases are at an elevated temperature by which a heat transfer to a flowing heat exchange fluid, such as water located in the chamber 24 can be effected.

As has already been noted, the present invention differs from the prior device in providing a double shell heat exchanger, both inner and outer shell being formed of open-ended single metallic tubes. As seen best in FIG. 4, it will be recognized that during operation the fluid flow rate is such that the entire chamber 24 formed between the inner and outer shells is filled with the fluid, passing in contact with the outer surface of the inner shell, effecting heat conduction, through the entire surface. The face or thickness of the column of fluid contained in chamber 24 is relatively small so that heat conduction from the inner shell is quite rapid and the entire body of water in the chamber 24 is subject to heat transfer at all times.

During operation, the fluid to be heated takes a helical flow pattern, thereby reducing the effect of the insulating boundary layers and providing a high heat transfer.

The boiler may be enclosed in a layer of insulation, abutting the outer surface of the outer shell and a surrounding decorative housing.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A boiler for a radiant heated water system comprising a pair of concentrically arranged outer and inner open-ended cylindrical shells defining therebetween a chamber for holding water, a cap closing each end of said pair of cylindrical shells and removably secured thereto, an inlet for the supply of water to said chamber extending through the outer shell at one end and an outlet for the discharge of water therefrom at the other end, a combustion element extending into the inner shell from said other end providing a source of heat radiating outwardly therefrom against the inner shell, a continuous elongated helically wound wire arranged between said shells, in abuttment with each wall dividing said chamber into a continuous helical passage from said inlet to said outlet, and a plurality of longitudinally extending ribs on the interior surface of said inner shell to facilitate heat transfer from said combustion element to water flowing in said chamber between said shells.

2. The heat exchanger according to claim 1 including a porous plug arranged in the one end of said inner shell to regulate the exhaust of said heat source therethrough, said plug be held in force fit with the ribs of said inner shell and having an outlet extending through the cap at said one end.

* * * * *